United States Patent [19]

Petro

[11] Patent Number: 4,682,939

[45] Date of Patent: Jul. 28, 1987

[54] GEAR PUMP OR MOTOR WITH TOOTH TIPS OF DISSIMILAR METAL

[75] Inventor: John D. Petro, Hubbard, Ohio

[73] Assignee: Commercial Shearing, Inc., Youngstown, Ohio

[21] Appl. No.: 843,675

[22] Filed: Mar. 25, 1986

[51] Int. Cl.[4] ..... F03C 2/08; F04C 2/18

[52] U.S. Cl. ..... 418/178; 418/179; 418/206

[58] Field of Search ..... 418/178, 179, 205, 206; 29/156.4 R

[56] References Cited

U.S. PATENT DOCUMENTS 2,491,677 12/1949 McCulloch ..... 418/179
3,483,825 12/1969 Difford et al. ..... 418/178
3,544,244 12/1970 Haupt ..... 418/178
3,878,880 4/1975 Jones ..... 418/178
3,886,637 6/1975 Ellis et al. ..... 418/178

FOREIGN PATENT DOCUMENTS 2149856 6/1985 United Kingdom ..... 418/178

*Primary Examiner*—John J. Vrablik
*Attorney, Agent, or Firm*—Eugene F. Buell

[57] ABSTRACT

A gear pump and motor is provided having increased life and efficiency as a result of improved wiping action of the gear teeth on the inner periphery of the pump chamber. This is accomplished by providing a non-smooth surface layer of a dissimilar metal such as a carbide on the tip ends of the teeth.

9 Claims, 2 Drawing Figures

GEAR PUMP OR MOTOR WITH TOOTH TIPS OF DISSIMILAR METAL

This invention relates to gear pumps and motors and particularly to gear pumps having a smooth clean wipe surface between the gear tips and housing.

In gear pumps and motors, the problem of obtaining a smooth clean housing wipe during the break-in period, and then maintaining this condition during the entire life of the pump or motor has long been recognized as a serious problem with gear pumps and motors.

In investigating this problem, I have discovered that the problem really takes two forms, i.e. that there are two basic types of cut or wiping conditions which exist depending upon whether the gear unit is run as a pump or as a motor. What I shall call Type I wipe occurs generally when a gear unit is operated as a pump. I have found that this Type I wipe generates a crushing action on the gear tips caused by iron particles breaking away from the gear housing due to the gear tips loading into the gear housing bore. As a result the gear tips and gear bore become rough because of this action. This is precisely contrary to the desired condition. The other type of wiping, which I call Type II wipe, generally occurs when the gear unit is run as a motor. This type of wipe is caused by iron particles cold welding to the top of the gear tips. This type of wipe, i.e. welding is also caused by the gear tips loading into the gear housing as the gear is rotating.

My further research into this problem has shown that gear tip crushing as in Type I wipe, and cold welding of the gear tips, as in Type II wipe, can be prevented. When these two types of wipe are prevented, the housing bore wipe becomes smooth and clean. This, in turn, increases the units useful life and reduces leakage across the gear tips.

I have discovered that by coating the gear tips with a dissimilar metal having a matted or rough surface finish both Types of wipe problem can be significantly reduced, if not eliminated.

I provide a gear pump and motor structure comprising a housing and a pair of gears having intermeshing teeth running in wiping contact with said housing, said teeth having tips of dissimilar metal having a non-smooth, matted or rough surface finish. Preferably the surface finish is approximately 90 MIF. The dissimilar metal is preferably a wear resistant material such as metal carbide, tungsten carbide, titanium carbide or the like applied by electrical deposition.

In the foregoing general description I have set out certain objects, purposes and advantages of this invention. Other objects, purposes and advantages of this invention will become apparent from a consideration of the following description and the accompanying drawings in which.

Figure 1:
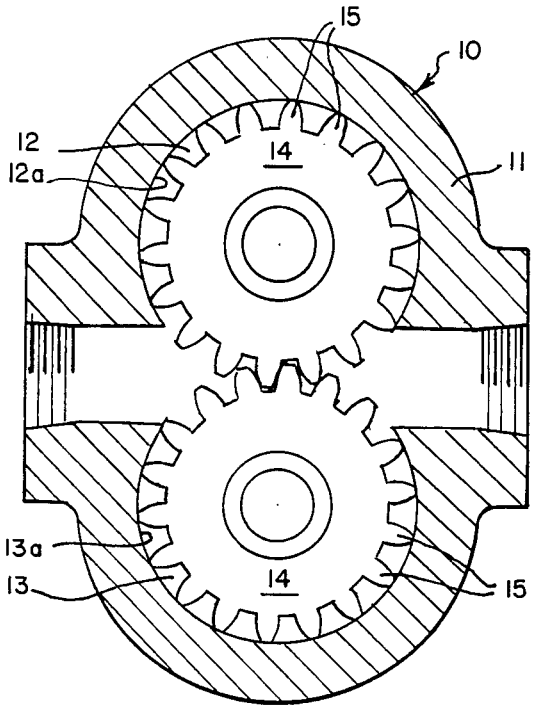
FIG. 1 is a section through a gear pump or motor according to this invention.
Figure 2:
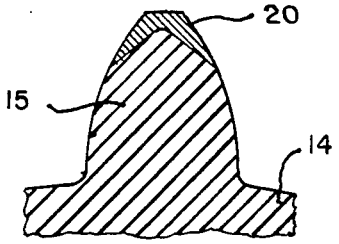
FIG. 2 is a section through a gear tooth according to this invention.

Referring to the drawings, I have illustrated a gear pump 10 of conventional design but with the gears prepared according to this invention. The pump 10 is made up of a housing 11 having pump chambers 12 and 13 each carrying a gear 14 with teeth 15 which intermesh between the two gears and which wipe against the inner peripheral surfaces 12*a* and 13*a* of the pump chamber 12 and 13.

The end of each tooth 15 is coated with a thin surface layer of tungsten carbide 20 or the like. As the gears rotate the gear teeth ends with the surface layer 20 rub on the inner peripheral surfaces 12*a* and 13*a* of the gear chambers 12 and 13 to wipe a smooth clean surface, eliminating the long standing problem of roughened surfaces which reduces gear pump efficiency and life.

In the foregoing specification, I have set out certain preferred practices and embodiments of this invention, however, it will be understood that this invention will be otherwise embodied within the scope of the following claims.

I claim:

1. A gear pump or motor structure comprising a housing having a chamber, a pair of gears having intermeshing teeth running wiping contact with the chamber, said teeth having tips of a separate dissimilar harder metal from that of the gear teeth and the chamber surface with a non-smooth surface finish on said teeth tips whereby said chamber working surface is wiped to a smooth clean surface in operation.

2. A gear pump or motor as claimed in claim 1 wherein the chamber is generally in the form of a figure 8 with a gear running in each separate lobe of the chamber.

3. A gear pump or motor as claimed in claim 1 or 2 wherein the surface finish on the dissimilar metal tips is approximately 90 MIF.

4. A gear pump or motor as claimed in claim 1 or 2 wherein the dissimilar metal is a metal carbide.

5. A gear pump or motor as claimed in claim 3 wherein the dissimilar metal is a metal carbide.

6. A gear pump or motor as claimed in claim 4 wherein the metal carbide is tungsten carbide.

7. A gear pump or motor as claimed in claim 5 wherein the metal carbide is tungsten carbide.

8. A gear pump or motor as claimed in claim 4 wherein the metal carbide is titanium carbide.

9. A gear pump or motor as claimed in claim 5 wherein the metal carbide is titanium carbide.

* * * * *